US005135832A

United States Patent [19]

Sacripante et al.

[11] Patent Number: 5,135,832

[45] Date of Patent: Aug. 4, 1992

[54] COLORED TONER COMPOSITIONS

[75] Inventors: Guerino Sacripante, Cambridge, Canada; Michael J. Levy, Webster, N.Y.; Beng S. Ong, Mississauga, Canada; Richard B. Lewis, Williamson, N.Y.

[73] Assignee: Xerox Corporation, Stamford, Conn.

[21] Appl. No.: 609,333

[22] Filed: Nov. 5, 1990

[51] Int. Cl.[5] ..... G03G 9/14

[52] U.S. Cl. ..... 430/106.6; 430/111; 430/138

[58] Field of Search ..... 430/106.6, 110, 138, 430/111

[56] References Cited

U.S. PATENT DOCUMENTS

| | | | |
|---|---|---|---|
| 2,986,521 | 5/1961 | Wielicki | 252/62.1 |
| 4,051,077 | 9/1977 | Fisher | 252/62.1 P |
| 4,108,653 | 8/1978 | Peters | 96/1 SD |
| 4,301,228 | 11/1981 | Kori et al. | 430/122 |
| 4,626,487 | 12/1986 | Mitsuhashi et al. | 430/109 |
| 4,734,350 | 3/1988 | Lin et al. | 430/110 |
| 4,803,144 | 2/1989 | Hosoi | 430/106.6 |
| 4,937,167 | 6/1990 | Moffat et al. | 430/137 |
| 4,973,541 | 11/1990 | Kohri et al. | 430/138 |

*Primary Examiner*—John Goodrow
*Attorney, Agent, or Firm*—E. O. Palazzo

[57] ABSTRACT

A colored magnetic encapsulated toner composition comprised of a core comprised of a polymer binder, a colorless or light colored magnetic material, a color pigment, dye or mixture thereof excluding black, and a whitening agent; and which core is encapsulated in a polymeric shell containing a metal oxide.

55 Claims, No Drawings

COLORED TONER COMPOSITIONS

BACKGROUND OF THE INVENTION

The present invention is generally directed to toner compositions, and more specifically to colored encapsulated toner compositions. In one embodiment, the present invention is related to colored magnetic toner compositions that can, for example, be selected for single component development, and more specifically for a number of inductive single component development processes. In an embodiment the present invention relates to toner compositions comprised of a polymer binder, a colorless or lightly colored magnetic material, especially a grayish (substantially gray in color) magnetite, a whitening agent, a color pigment, dye or mixture thereof, and a conductive fine powder comprised of metal oxide, such as, for example, powdered tin oxide or titanium oxide, or a mixture of metal oxides. In one specific embodiment of the present invention, there are provided colored magnetic encapsulated toner compositions comprised of a core comprised of a polymer binder, a substantially colorless magnetic material, a whitening agent, and a color pigment, and wherein the core is encapsulated in a polymeric coating such as a polyurea, a polyurethane, a polyamide, a polyester, or mixtures thereof, and wherein the shell contains a conductive powdered additive comprised of a conductive metal oxide of, for example, tin oxide doped with bismuth. The aforementioned encapsulated toner compositions generally possess a volume resistivity of from about $10^3$ to about $10^8$ ohm-cm, and preferably a volume resistivity of about $10^4$ to about $10^6$ ohm-cm. This level of toner conductivity is particularly suited for use in a number of inductive single component development systems. In another embodiment of the present invention, there is provided a colored magnetic encapsulated toner composition comprised of a core of an acrylic, methacrylic, styrene polymer binder, or the copolymeric derivatives thereof, such as poly(butyl methacrylate), lauryl methacrylate-stearyl methacrylate copolymer, styrene-butyl methacrylate copolymer, and the like, a colorless or slightly colored magnetic material, a whitener, and colored, other than black pigment particles, and encapsulated thereover a polymeric shell, wherein the shell has present thereon a conductive powder comprised of certain metal oxides, or mixtures thereof. The shell polymer of the present invention may contain a flexible structural moiety such as a polyether or polymethylene segment to improve its packing, and thus enhance resistance to core component diffusion or leaching through the toner shell structure. A further embodiment of the present invention relates to the preparation of conductive fine powdered metal oxides or mixed oxides, and their applications as toner conductivity control and surface release agents.

The metal oxide powders preferably possess a primary particle size, or average particle size diameter of less than about 1,000 Angstroms, and more preferably in average particle diameter of from about 100 to about 1,000 Angstroms. These powders can be optionally treated, preferably surface treated with certain organosilane reagents primarily to improve their powder flow properties. Specifically, the conductive powders can possess a specific resistivity of less than about 1,000 ohm-cm, and preferably less than about 100 ohm-cm such that when utilized as toner surface additives in an effective amount of, for example, generally less than 20 weight percent, they can impart to the toner a volume resistivity of from about $10^3$ to $10^8$ ohm-cm, and preferably from about $10^4$ to $10^6$ ohm-cm. Examples of advantages associated with the encapsulated compositions of the present invention in embodiments thereof include brilliant image color, and wide color variety; relatively high surface conductivity and thus suitability for use in many inductive single component development systems; cold pressure fixability; high image fix; nonagglomerating and excellent shelf-life stability of, for example, up to 2 years in some instances; and suitability for use in highlight color reprographic processes, especially xerographic and ionographic imaging and printing processes. Additionally, the use of the aforementioned conductive powders can also enhance the toner powder flow characteristics, thus eliminating, if desired, the utilization of other additives such as Aerosils, and zinc stearate for surface release and flow properties. Another advantage of the conductive oxide powder is related to its ability to reduce the toner's sensitivity to humidity.

The toner compositions of the present invention can be selected for a variety of known reprographic imaging processes including electrophotographic and ionographic processes. In one embodiment, the encapsulated toner compositions can be selected for pressure fixing processes wherein the image is fixed with pressure. Pressure fixing is common in ionographic processes in which latent images are generated on a dielectric receiver such as silicon carbide, reference U.S. Pat. No. 4,885,220, the disclosure of which is totally incorporated herein by reference and entitled Amorphous Silicon Carbide Electroreceptors. The latent images can then be toned with a conductive encapsulated toner of the present invention by inductive single component development, and transferred and fixed simultaneously (transfix) in one single step onto paper with pressure. Specifically, the toner compositions of the present invention can be selected for the commercial Delphax printers, such as the Delphax S9000 TM, S6000 TM, S4500 TM, S3000 TM, and Xerox Corporation printers such as the 4060 TM and 4075 TM wherein, for example, transfixing is utilized. In another embodiment, the toner compositions of the present invention can be utilized in xerographic imaging apparatuses wherein image toning and transfer are accomplished electrostatically, and transferred images are fixed in a separate step by means of a pressure roll with or without the assistance of thermal or photochemical energy fusing.

Encapsulated and cold pressure fixable toner compositions are known. Cold pressure fixable toners have a number of advantages in comparison to toners that are fused by heat, primarily relating to the utilization of less energy since, for example, these toner compositions can be fused at room temperature. Cold pressure fixability also enables the instant-on copy machine feature. Nevertheless, many of the prior art cold pressure fixable toner compositions suffer from a number of deficiencies. For example, the prior art colored toners, particularly magnetic colored toners, usually do not possess sufficiently low volume resistivity of, for example, $10^4$ to $10^6$ ohm-cm to be effectively useful for inductive single component development; the prior art magnetic colored toners also do not usually offer the desirable color quality or a wide color variety; and they are usually fixed under high pressure of, for example, in excess of 3,500 psi, which has a tendency to severely affect the image quality of the toner selected. Specifically, the high fixing pressure can lead to images of low resolution and severe image offset. Also, with some of the prior art cold pressure toner compositions inclusive of black toners, substantial image smearing can result from the high pressures selected. The high fixing pressure also generates in some instances objectionable paper calendering problems. In addition, a number of the prior art encapsulated toners, inclusive of black toners, often suffer from the known image ghosting problem when used in the transfix ionographic printers such as the Delphax printers. Additionally, the preparative processes of the prior art pressure fixable encapsulated toner compositions usually employ flammable organic solvents as the diluting vehicles and reaction media, and this could drastically increase the toner's manufacturing cost because of expensive solvent separation and recovery procedure, and the need for explosion-proof equipment, and the necessary precautions that have to be undertaken to prevent the solvent associated hazards. Moreover, the involvement of a solvent in the prior art processes also may decrease the product yield per unit volume of reactor size. Furthermore, with many of the prior art processes narrow size dispersity toner particles cannot be easily obtained by conventional bulk homogenization techniques as contrasted with the process of the present invention wherein narrow size dispersity toner particles can be more easily and economically obtained in embodiments thereof. These, and other disadvantages are eliminated, substantially eliminated, or minimized with the toners and process of the present invention. More specifically, with the encapsulated toners of the present invention, control of the toner surface conductivity, and toners with excellent color quality can be achieved. Also, with the encapsulated toners of the present invention undesirable leaching or loss of core components is minimized or avoided, and image ghosting is eliminated, in many instances, primarily because of the utilization of an impermeable polymeric shell in some embodiments. Image ghosting, which is one of the known common phenomena in transfix ionographic printing processes, refers to, for example, the contamination of dielectric receiver by residual toner materials which cannot be readily removed in the cleaning process. The result is the retention of latent images on the dielectric receiver surface after cleaning, and the subsequent unwarranted development of these images. One of the common causes of image ghosting is related to the leaching of the sticky core binder out to the toner's surface leading to their adherence to the dielectric receiver during the image development process.

In a patentability search report the following U.S. patents were listed: U.S. Pat. No. 4,803,144 which discloses an encapsulated toner with a core containing as a magnetizable substance, a magnetite, see Example 1, which is black in color, wherein on the outer surface of the shell there is provided a white electroconductive powder, preferably a metal oxide powder, such as zinc oxide, titanium oxide, tin oxide, silicon oxide, barium oxide and others, see column 3, line 59 to column 4; in column 8 it is indicated that the colorant can be carbon black, blue, yellow, and red; in column 14 it is indicated that the electroconductive toner was employed in a one component developing process with magnetic brush development, thus it is believed that the toner of this patent is substantially insulating; U.S. Pat. No. 4,937,167 which relates to controlling the electrical characteristics of encapsulated toners, see for example columns 7 and 8, wherein there is mentioned that the outer surface of the shell may contain optional surface additives 7, examples of which include fumed silicas, or fumed metal oxides onto the surfaces of which have been deposited charge additives, see column 17 for example; U.S. Pat. No. 4,734,350 which discloses an improved positively charged toner with modified charge additives comprised of flow aid compositions having chemically bonded thereto, or cemiadsorbed on the surface certain amino alcohol derivatives, see the Abstract for example; the disclosures of each of the aforementioned patents being totally incorporated herein by reference; and, which according to the search report are not significant but may be of some background interest U.S. Pat. Nos. 2,986,521; 4,051,077; 4,108,653; 4,301,228; 4,301,228 and 4,626,487.

In a patentability search report in a copending application U.S. Ser. No. 524,946, the disclosure of which is totally incorporated herein by reference, the following U.S. Pat. patents were listed: U.S. Pat. No. 4,514,484 directed to a powder suitable for developing latent images comprising of magnetic particles coated with a mixture of a thermoplastic resin and a silane, see for example the Abstract of the Disclosure; note column 3, beginning at line 15, wherein it is indicated that into the organic thermoplastic resin is incorporated a silane selected from those illustrated; also incorporated into the thermoplastic resin are magnetic materials, see column 3, beginning at line 35; U.S. Pat. No. 4,565,773 directed to dry toners surface coated with nonionic siloxane polyoxy alkalene copolymers with a polar end, see the Abstract of the Disclosure; and primarily of background interest is U.S. Pat. Nos. 4,640,881; 4,740,443; 4,803,144 and 4,097,404, the disclosure of which is totally incorporated herein by reference.

The following prior art, all U.S. patents, are mentioned: U.S. Pat. No. 4,770,968 directed to polysiloxane butadiene terpolymer toner resins, reference for example column 4, and note the formulas of FIGS. 1 to 6, including FIG. 2B, which toners can be selected wherein silicone release oils are avoided, with no apparent teaching in this patent directed to encapsulated toners; U.S. Pat. No. 4,814,253 directed to encapsulated toners comprised of domains containing a polymer component having dispersed therein a release composition and thereover a host resin component comprised of toner rein particles and pigment particles, see for example the Abstract of the Disclosure and column 4, and note column 4 wherein there is illustrated as one of the components of the encapsulated toner domains comprised of styrene butadiene block polymers such as Kraton, styrene copolymers, or styrene siloxanes, which components have entrapped or dissolved therein mineral oils or silicon oils; U.S. Pat. No. 4,430,408 relating to developer compositions containing a fluorene modified alkyl siloxane and a surface treatment carbon black, reference the Abstract of the Disclosure for example; U.S. Pat. No. 4,758,491 relating to dry toner and developer compositions with a multiphase polyorgano siloxane block or graft condensation copolymer, which provides polyorgano siloxane domains of a particular size and concentration at the toner particle surfaces; and U.S. Pat. No. 4,820,604 directed to toner compositions comprised of resin particles, pigment particles, and a sulfur containing organo polysiloxane wax such as those of the formulas illustrated in the Abstract of the Disclosure.

There are disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-comaleic anhydride as a soft component. Interfacial polymerization processes are also selected for the preparation of the toners of this patent. Also, there are disclosed in the prior art encapsulated toner compositions containing in some instances costly pigments and dyes, reference for example the color photocapsule toners of U.S. Pat. Nos. 4,399,209; 4,482,624; 4,483,912 and 4,397,483.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process.

Disclosed in U.S. Pat. No. 5,045,422 entitled Encapsulated Toner Compositions, the disclosure of which is totally incorporated herein by reference, are encapsulated compositions containing cores comprised of a fluorocarbon-incorporated polymer binder. More specifically, there is illustrated in the aforementioned patent an encapsulated toner composition comprised of a core with a fluorocarbon-incorporated resin binder, pigment or dyes, and a polymeric shell; and an encapsulated toner composition comprised of a core comprised of a fluorocarbon-incorporated resin binder derived from the copolymerization of an addition-type monomer and a functionalized fluorocarbon compound represented by Formula (I), wherein A is a structural moiety containing an addition-polymerization functional group; B is a fluorine atom or a structural moiety containing an addition-polymerization functional group; and x is the number of difluoromethylene functions, pigment or dyes, and a polymeric shell. Also, illustrated in U.S. Pat. No. 5,013,630 entitled Encapsulated Toner Compositions, the disclosure of which is totally incorporated herein by reference, is an encapsulated toner composition comprised of a core comprised of pigments or dyes, and a polysiloxane-incorporated core binder, which core is encapsulated in a shell. Moreover, illustrated in U.S. Pat. No. 5,023,159, the disclosure of which is totally incorporated herein by reference, are encapsulated toners with a soft core comprised of silane modified polymer resin, a colorant, and a polymeric shell thereover. Specifically, in one embodiment there are disclosed in the aforementioned patent encapsulated toners comprised of a core containing a silane-modified polymer resin, preferably obtained by free-radical polymerization, silane-modified pigment particles or dyes and thereover a shell, preferably obtained by interfacial polymerization. U.S. Pat. No. 5,023,159 in one embodiment is directed to an encapsulated toner composition comprised of a core comprised of the polymer product of a monomer or monomers, and a polyfunctional organosilicon component, and more specifically wherein the core is comprised of a silane-modified polymer resin having incorporated therein an oxysilyl (I), a dioxysilyl (II), or a trioxysilyl (III) function of the following formulas, pigment, dye particles or mixtures thereof; and a polymeric shell.

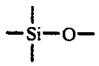
(I)

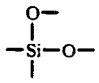
(II)

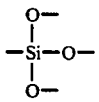
(III)

The aforementioned toners can be prepared by a number of different processes including the chemical microencapsulation method which comprises (1) mixing or blending of a core monomer or monomers, a functionalized organosilane, a free radical initiator or initiators, pigment, and a shell monomer or monomers; (2) dispersing the resulting mixture of pigmented organic materials by high shear blending into stabilized microdroplets in an aqueous medium with the assistance of suitable dispersants or suspension agents; (3) thereafter subjecting the aforementioned stabilized microdroplets to a shell forming interfacial polycondensation; and (4) subsequently forming the core binder by heat induced free radical polymerization within the newly formed microcapsules. The shell forming interfacial polycondensation is generally accomplished at ambient temperature, but elevated temperatures may also be employed depending on the nature and functionality of the shell monomer selected. For the core polymer resin forming free radical polymerization, it is generally effected at a temperature of from ambient temperature to about 100° C., and preferably from ambient or room temperature, about 25° C. temperature to about 85° C. In addition, more than one initiator may be utilized to enhance the polymerization conversion, and to generate the desiired molecular weight and molecular weight distribution. The toners of the present invention can be prepared by similar processes wherein there are added to the encapculated particles the conductive metal oxide powders instead of the colloidal graphite, known carbon blacks, such as Black Pearls available from Cabot Corporation, or mixtures thereof as disclosed in some of the aforementioned copending applications. Other substantial differences include the utilization of colorless or light colored magnetic material and whitening agent in the toners of the present invention.

Illustrated in copending application U.S. Ser. No. 609,316, the disclosure of which is totally incorporated herein by reference, are toners free of encapsulation and comprised, for example, of a polymer resin or resins, an optional waxy, lubricating or low surface energy substance, a colorless or light colored magnetic material, a color pigment, dye or mixture thereof excluding black, and a whitening agent, and wherein the surface of the toner contains a conductive metal oxide.

Accordingly, there is a need for colored encapsulated toner compositions, and in particular colored magnetic encapsulated toner compositions, with many of the advantages illustrated herein. Also, there is a need for pressure fixable colored magnetic encapsulated toners which provide high quality images with acceptable fixing levels of, for example, over 80 percent at low fixing pressure, of for example, 2,000 psi. Moreover, there is a need for colored magnetic encapsulated toners, wherein image ghosting and the like can be avoided or minimized. Furthermore, there is a need for nonagglomerating colored magnetic encapsulated toners which possess a long shelf life exceeding, for example, 12 months. Also, there is a need for colored magnetic encapsulated toners with excellent surface conductivity characteristics and a volume resistivity of, for example, from about $10^3$ ohm-cm to about $10^8$ ohm-cm, and preferably from about $10^4$ ohm-cm to about $10^6$ ohm-cm, thus enabling their use in a number of known inductive single component development systems. Furthermore, there is a need for colored magnetic encapsulated toners with excellent powder flow and surface release properties enabling their selection for use in imaging systems without the use of surface release fluids such as silicone oils to prevent image offsetting to the fixing or fuser roll. Still another need resides in the provision of colored magnetic toners that are insensitive to changes in humidity. There is also a need for conductive surface additives which are capable of imparting desirable levels of surface conductivity to colored toners without adversely affecting their image color quality. Another associated need resides in the provision of preparative quality. Another associated need resides in the provision of preparative processes for obtaining conductive powdered metal oxides and mixed oxides, such as, for example, tin oxides, which have primary particle sizes of less than about 1,000 Angstroms, and specific resistivities of less than 1,000 ohm-cm, and which powders are useful as surface conductivity control and release agents for colored magnetic toner compositions which are suitable for inductive single component development. Additionally, there is a need for simple and economic processes for the preparation of colored magnetic encapsulated toners. Specifically, there is a need for a chemical microencapsulation process for colored magnetic encapsulated toners, and which process involves a shell forming interfacial polycondensation and a core binder forming free radical polymerization, and wherein flammable organic solvents are not employed in their preparation in some embodiments. Moreover, there is a need for enhanced flexibility in the design and selection of the shell and core materials for pressure fixable colored magnetic encapsulated toners and/or flexibility in controlling the toner physical properties such as the bulk density, particle size, and size dispersity.

SUMMARY OF THE INVENTION

It is therefore a feature of the present invention to provide colored toner compositions with many of the advantages illustrated herein.

In another feature of the present invention there are provided colored magnetic encapsulated toner compositions comprised of a core of polymer binder, a color pigment or dye, a colorless or lightly colored magnetic material, and a whitener, and thereover a polymeric shell prepared, for example, by interfacial polymerization and wherein the shell has incorporated therein, thereon, or combinations thereof certain conductive metal oxide powders.

Another feature of the present invention is the provision of colored magnetic encapsulated toners which provide brilliant colored images.

A further feature of the present invention relates to colored toner compositions wherein core component leaching or loss is eliminated in some embodiments, or minimized in other embodiments.

A still further feature of the present invention is the provision of colored magnetic encapsulated toners wherein toner agglomeration is eliminated or minimized in some embodiments.

Additionally, another feature of the present invention is to provide colored magnetic encapsulated toners with excellent powder flow and release properties.

Moreover, another feature of the present invention is the provision of colored magnetic encapsulated toners wherein image offsetting is eliminated in some embodiments, or minimized in other embodiments.

In still another feature of the present invention there are provided colored magnetic encapsulated toners with extended shelf life.

A further feature of the present invention relates to colored magnetic encapsulated toners which are suitable for inductive single component development systems.

Another feature of the present invention is directed to pressure fixable colored magnetic encapsulated toners which offer high image fixing properties under low pressure fixing conditions.

An associated feature of the present invention is the provision of preparative processes for obtaining conductive fine metal oxide powders.

An additional feature of the present invention is related to colored magnetic encapsulated toners which are insensitive to changes in humidity.

Another feature of the present invention resides in the provision of colored encapsulated conductive toners with a volume resistivity of from about $10^3$ to about $10^8$, and preferably from about $10^4$ to about $10^6$ ohm-cm, which toner enables developed images with brilliant colors.

Another feature of the present invention resides in the provision of colored encapsulated conductive toners with a volume resistivity of from about $10^3$ to about $10^8$, and preferably from about $10^4$ to about $10^6$ ohm-cm, and wherein the shell thereof contains a very fine metal oxide powder with an average diameter of less than about 1,000 Angstroms, and more specifically from about 10 to about 1,000 Angstroms.

Additionally, in another feature of the present invention there are provided colored magnetic encapsulated toner compositions suitable for electrostatic imaging and printing apparatuses.

These and other features of the present invention can be accomplished by providing colored toner compositions, and more specifically colored magnetic encapsulated toner compositions comprised of a core of a polymer binder, a colorant, a colorless or lightly colored magnetic material and a whitener, and thereover a polymeric shell preferably comprised of, for example, a polyether-containing polyurea material, and which shell contains therein or thereon a conductive metal oxide powder. The encapsulated toners of the present invention can be prepared by a number of different methods including the known chemical microencapsulation processes involving a shell forming interfacial polycondensation and a core binder forming free radical polymerization. The aforementioned preparative process is comprised of (1) mixing or blending of a core monomer or monomers, up to 10, and preferably 5 in some embodiments, a free radical initiator or initiators, pigments, dyes or a mixture thereof, a colorless or lightly colored magnetic material, a whitener, and an oil-soluble shell precursor or precursors; (2) dispersing the resulting mixture by high shear blending into stabilized microdroplets in an aqueous medium containing suitable dispersants or suspension agents; (3) thereafter subjecting the aforementioned stabilized microdroplets to a shell forming interfacial polycondensation by adding a water-soluble shell monomer or monomers; (4) subsequently forming the core binder by heat induced free radical polymerization within the newly formed microcapsules; and (5) washing and drying the resulting encapsulated particles, and surface treating them with conductive metal oxide powder to afford the colored magnetic encapsulated toner of the present invention. The shell forming interfacial polycondensation is generally accomplished at ambient temperature, about 25° C., but elevated temperatures may also be employed depending on the nature and functionality of the shell precursors selected. The core binder forming free radical polymerization is generally effected at a temperature of from ambient temperature to about 100° C., and preferably from ambient or room temperature, about 25° C. to about 90° C. In addition, more than one known initiator may be utilized to enhance the polymerization conversion, and to generate the desired molecular weight and molecular weight distribution. The surface conductivity characteristics of the toners of the present invention are primarily achieved by powder coating the toners with conductive fine powdered metal oxides or mixed oxides. Toners with conductive additives such as carbon black, graphite, and mixture thereof may not be suitable for magnetic colored toner compositions as they usually render the toners black in color, a disadvantage avoided or minimized with toners of the present invention in embodiments thereof. The aforementioned metal oxide surface additives of the present invention may also serve to impart the desired powder flow and surface release properties to the resultant toners.

Thus, in one embodiment the present invention is directed to a simple and economical process for pressure fixable colored magnetic encapsulated toner compositions by a chemical microencapsulation method involving a shell forming interfacial polycondensation and a core binder forming free radical polymerization, and where there are selected as the core binder precursors an addition-type monomer or monomers, and as shell polymer precursors polycondensation reagents with at least one of them being oil soluble, and at least one of them water soluble, and which precursors are capable of undergoing condensation polymerization at the microdroplet/water interface leading to shell formation. The resultant encapsulated particles are subsequently rendered conductive by application to their surfaces of a conductive metal oxide or mixed oxide powder, which application can be accomplished by known conventional dry blending and mixing techniques. Specifically, the volume resistivity of the encapsulated toners can be reduced to a level of, for example, from about $10^3$ ohm-cm to about $10^8$ ohm-cm by blending the toner with an effective amount of, for example, from about 1 to about 15 weight percent of conductive fine metal oxide powder, which metal oxide powder has a low specific resistivity of generally less than about 1,000 ohm-cm, and more specifically less than 100 ohm-cm. Furthermore, the metal oxide powder can possess a primary particle size of less than about 1,000 Angstroms, and more specifically less than about 150 Angstroms.

The encapsulated toners of the present invention generally have an average particle diameter of from about 5 to about 50 microns, a saturation magnetic moment of from about 25 to about 60 emu per gram, and a volume resistivity of from about $10^3$ to about $10^8$ ohm-cm, and preferably from about $10^4$ to $10^6$ ohm-cm, with the latter range of volume resistivity being particularly ideal for a number of commercial inductive single component development systems such as the Delphax printers S3000 TM, S4500 TM, and S6000 TM and the Xerox Corporation printer 4075 TM.

The aforementioned conductive metal oxide powders are available, or can in one embodiment be prepared by (1) high temperature flame hydrolysis of volatile metal compounds, such as titanium tetrahalide, especially the chloride, or tin tetrahalide, especially the chloride, in a hydrogen-oxygen flame, optionally in the presence of another metal dopant such as bismuth halide, especially the chloride in effective amounts of from about 0.1 to about 50 weight percent, and more specifically from about 5 to 15 weight percent, to yield highly dispersed metal oxide or mixed oxide powder; and (2) subsequently heating the resultant metal oxide powder at a temperature of, for example, from about 400° C. up to 600° C. under a hydrogen atmosphere to remove the residual halides. Illustrative examples of powdered metal oxides suitable for the toners of the present invention include oxides or mixed oxides of aluminium, antimony, barium, bismuth, cadmium, chromium, germanium, indium, lithium, magnesium, molybdenum, nickel, niobium, ruthenium, silicon, tantalum, titanium, tin, vanadium, zinc, zirconium, and the like. The conductive metal oxide powders can be surface treated by the addition thereto with mixing of certain silane agents to, for example, improve their powder flow properties and to reduce their sensitivity to moisture.

Embodiments of the present invention include a colored magnetic encapsulated toner composition comprised of a core comprised of a polymer binder, a colorless or light colored magnetic material, a color pigment, dye or mixture thereof excluding black, and a whitening agent, and which core is encapsulated in a polymeric shell containing therein or thereon a conductive metal oxide powder; a colored conductive magnetic encapsulated toner composition comprised of a core comprised of a polymer binder, a substantially colorless magnetic material, a color pigment, exclusing black, and a whitening agent, and which core is encapsulated in a polymeric shell containing thereon a conductive metal oxide powder, and wherein the toner has a volume of from about $10^3$ ohm-cm to about $10^8$ ohm-cm; a colored magnetic encapsulated toner composition comprised of a core comprised of a polymer binder, a grayish color magnetic material, a pigment, and a whitening agent, and wherein the core is encapsulated in a polymeric shell containing a conductive metal oxide powder, and wherein the toner has a volume of from about $10^4$ ohm-cm to about $10^6$ ohm-cm., which metal oxide can be comprised of the oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, zirconium, mixtures thereof, and the like.

Examples of core binders present in effective amounts, for example, of from about 20 to about 90 weight percent, that can be selected include, but are not limited to, known polymers such as addition polymers, such as acrylate, methacrylate, styrene polymers and the like, which binders can be obtained by in situ polymerization of addition monomers within the microcapsules after shell formation, and wherein the monomers can be selected from the group consisting preferably of methyl acrylate, metal methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and other known addition monomers, reference for example U.S. Pat. No. 4,298,672, the disclosure of which is totally incorporated herein by reference, and mixtures thereof.

Various known colorants or pigments present in the core in an effective amount of, for example, from about 1 to about 20 percent by weight of toner, and preferably in an amount of from about 3 to about 10 weight percent, that can be selected include Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E. D. Toluidine Red and Bon Red C available from Dominion Color Corporation Ltd., Toronto, Ontario, NOVAperm Yellow FGL, Hostaperm Pink E from Hoechst, Cinquasia Magenta available from E. I. DuPont de Nemours & Company, Lithol Scarlet, Hostaperm Blue, Hostaperm Red, Hostaperm Green, PV Fast Green, Cinquasia Yellow, PV Fast Blue, and the like. Generally, colored pigments that can be selected are red, blue, green, brown, cyan, magenta, or yellow pigments, and mixtures thereof. Examples of magenta materials that may be selected as pigments include, for example, 2,9dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-(octadecyl sulfonamido) phthalocyanine, x-copper phthalocyanine pigment listed in the Color Index as CI 74160, CI Pigment Blue, and Anthrathrene Blue identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL.

Examples of typical known shell polymers include polyureas, polyamides, polyesters, polyurethanes, mixtures thereof, and other similar polycondensation products, which shell polymers may have optionally incorporated within their polymer structures certain soft and flexible segments such as polyether or polymethylene moiety. The shells are generally comprised of from about 5 to about 30 weight percent of the toner, and have a thickness generally, for example, of less than about 5 microns. Other shell polymers, shell amounts, and thicknesses may be selected.

The oil soluble shell forming precursors present in the microdroplet phase during the microencapsulation process are preferably comprised of diisocyanates, diacyl chloride, and bischloroformate having soft and flexible moieties such as polymethylene or polyether segments within their molecular structures. Optionally, appropriate polyfunctional crosslinking agents, in effective amounts, such as, for example, from about 1 to about 25 weight percent, such as triisocyanate, triacyl chloride, and the like, can also be added to generate crosslinked shell polymers to improve their mechanical strength. Illustrative examples of the shell precursors include the polyether-based polyisocyanate such as Uniroyal Chemical's diphenylmethane diisocyanate based liquid polyether Vibrathanes, B-635, B-843, and the like, and toluene diisocyanate based liquid polyether Vibrathanes, B-604, B-614, and the like, and Mobay chemical Corporation's liquid polyether isocyanate prepolymers, E-21 or E-21A, 743, 744, and the like, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, triethylene glycol bischloroformate, and the like. In addition, other polyfunctional reagents can also be added as coreactants to improve shell properties such as mechanical strength and pressure sensitivity. In one embodiment of the present invention, the aforementioned co-reactants can be selected from the group consisting of benzene diisocyanate, toluene diisocyanate, diphenylmethane diisocyanate, 1,6-hexamethylene diisocyanate, bis(4-isocyanatocyclohexyl)methane, MONDUR CB-60, MONDUR CB-75, MONDUR MR, MONDUR MRS 10, PAPI 27, PAPI 135, Isonate 143L, Isonate 181, Isonate 125M, Isonate 191, and Isonate 240. The water soluble shell forming monomer component,s which can be added to the aqueous phase, include polyamine or polyol including bisphenol. Illustrative examples of the water soluble shell monomers include ethylenediamine, tetramethylenediamine, pentamethylenediamine, 2-methylpentamethylene diamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylene diamine, bis(hexamethylene)-triamine, tris(2-aminoethyl)amine, 4,4'-methylene bis(-cyclohexylamine), bis(3-aminopropyl)ethylene diamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylene diamine, bisphenol A, bisphenol Z, and the like. When desired, a water soluble crosslinking component, such as triamine or triol, can also be added in effective amounts sufficient to introduce crosslinking into the shell polymer structure to improve its mechanical strength.

Examples of magnetic materials which can be selected for the toner compositions of the present invention, and which are present in an effective amount of, for example, from about 20 to about 60 weight percent, include iron powder, such as those derived from the reduction of iron tetracarbonyl, and commercially available from BASF as Sicopur 4068 FF TM; cobalt powder, commercially available from Noah Chemical Company; Metglas TM, Metglas TM ultrafine, commercially available from Allied Company; treated iron oxides such as Bayferrox AC5106M TM commercially available from Mobay; treated iron oxide TMB-50, commercially available from Magnox; carbonyl ison Sf TM, commercially available from Columbia Company; treated iron oxide MO-2230 TM, commercially available from Pfizer Company; nickel powder ONF 2460 TM, commercially available from Sherritt Gordon Canada Company; nickel powder; chromium powder; manganese ferrites; and the like. The preferred average diameter particle size of the magnetic material is from about 0.1 micron to about 6 microns, although other particle sizes may also be utilized.

Examples of conductive components present on the shell, and/or contained therein include powdered metal oxides and mixed oxides such as tin oxide, zinc oxide, yttrium oxide, vanadium oxide, tungsten oxide, titanium oxide, thalium oxide, tantalum oxide, silicon oxide, ruthenium oxide, rhodium oxide, platinum oxide, palladium oxide, niobium oxide, nickel oxide, molybdenum oxide, manganese oxide, magnesium oxide, lithium oxide, iridium oxide, cobalt oxide, chromium oxide, cesium oxide, calcium oxide, cadmium oxide, bismuth oxide berylium oxide, berylium oxide, barium oxide, antimony oxide, aluminum oxide, mixtures thereof, and the like. The conductive powders are present in various effective amounts, such as, for example, from 0.1 to about to about 20 weight percent and preferably from about 1 to about 15 weight percent. In one specific embodiment of the present invention, the conductive powdered metal oxide is a mixed oxide comprising from about 90 to about 95 weight percent of tin oxide and from about 5 to about 10 weight percent of bismuth oxide or antimony oxide. These oxides assist in enabling the formation of a relatively conductive colored magnetic encapsulated toner wherein high quality images can be obtained. Additionally, the aforementioned conductive metal oxide powders can be surface treated with a silane agent, such as, for example, hexamethyl disilazene or bis(trimethylsilyl)acetamide, and the like by exposing the oxide powders to the silane vapor at elevated temperature of, for example, 200° C. to 300° C. to improve their powder flow characteristics. The effective amount of silane agent is, for example, from about 0.1 to about 10 weight percent, and preferably from about 0.5 to 5 weight percent.

Various known whitening agents can be selected, such as an inorganic white powder selected from the group consisting of powdered aluminum oxide, barium oxide, calcium, carbonate, calcium oxide, magnesium oxide, magnesium stearate, titanium oxide, tin oxide, zinc xide, zinc stearate, and the like. The whitening agent is present in various effective amounts, for example from about 1 to about 20 weight percent.

In one specific embodiment of the present invention, there is provided an improved process for the preparation of colored magnetic encapsulated toner compositions, which process comprises mixing and dispersing a core monomer or monomers, a free radical initiator, colored pigment particles, dyes, or mixtures thereof, a magnetic material, a whitener, and a shell precursor into microdroplets of a specific droplet size in an aqueous medium containing a dispersant or suspension stabilizer wherein the volume average diameter of the microdroplet can be readily adjusted to be from about 5 microns to about 30 microns, with its volume average droplet size dispersity being less than 1.4 as determined from Coulter Counter measurements of the microcapsule particles after encapsulation; forming a microcapsule shell around the microdroplet via interfacial polymerization by adding a water soluble shell monomer component; and subsequently affecting a free radical polymerization to form the core binder within the newly formed microcapsules by, for example, heating the reaction mixture from room temperature to about 90° C. for a period of from about 1 to about 10 hours. Examples of known suspension stabilizers, present in effective amounts of, for example, from about 0.1 to about 15 weight percent in some embodiments selected for the process of the present invention include water soluble polymers such as poly(vinyl alcohols), methyl cellulose, hydroxypropyl cellulose, hydroxyethylmethyl cellulose and the like. Illustrative examples of known free radical initiators selected for the preparation of the toners of the present invention include azo compounds such as 2-2'-azodimethylvaleronitrile, 2-2'-azoisobutyronitrile, azobiscyclohexanenitrile, 2-methylbutyronitrile, Vazo 52, Vazo 64, commercially available, or mixtures thereof with the quantity of initiator(s) being, for example, from about 0.5 percent to about 10 percent by weight of that of the core monomer(s). Interfacial polymerization processes selected for the toner shell formation and shells thereof are as illustrated, for example, in U.S. Pat. Nos. 4,000,087 and 4,307,169, the disclosures of which are totally incorporated herein by reference. After the formation of encapsulated particles, the surface additive components, such as zinc stearate and conductive metal oxide powders, can be incorporated therein, or thereon by, for example, mixing or blending using conventional known processes. Thus in embodiments of the present invention there can be added to the toner product surface by mixing, for example, additional known surface and flow aid additives, such as Aerosils, such as Aerosil R972 TM, metal salts, metal salts of fatty acids, such as zinc stearate, and the like, in effective amounts of, for example, from about 0.05 to about 3, and preferably about 1 weight percent, reference for example the U.S. patents mentioned herein. Examples of the aforementioned additives are illustrated in U.S. Pat. Nos. 3,590,000; 3,720,617; 3,900,588 and 3,983,045, the disclosures of which are totally incorporated herein by reference.

The disclosures of each of the U.S. patents mentioned herein are totally incorporated herein by reference.

The following examples are being submitted to further define various aspects of the present invention. These examples are intended to be illustrative only and are not intended to limit the scope of the present invention.

EXAMPLE I

The following procedure illustrates the preparation of a conductive tin oxide powder that was utilized to assist in rendering the toner composition of the present invention to a specific level of conductivity.

Nitrogen gas (2.0 liters per minute) was bubbled through in tetrachloride (100 grams) at room temperature, about 25° C., and the resulting vapor was mixed with oxygen and hydrogen both flowing at about 0.7 liter per minute with the feed oxygen and hydrogen flow rates maintained at 0.85 liter per minute. The resulting mixture with approximate molar ratios of tin tetrachloride 1, nitrogen 59, hydrogen 15, and oxygen 15, was then burned into a flame. The combustion products were allowed to agglomerate in flight for about 10 seconds in a glass tube heated to about 200° C., and then collected in a Teflon TM fabric filter by suction. The collected tin oxide product (55.0 grams) was heated in a 500-milliter rotating flask at 400° C. A stream of air and water vapor was passed into the flask for 30 minutes, followed by a stream of hydrogen gas, argon gas and water vapor for another 30 minutes. The gas flow rate was adjusted to provide more than 10 flask volume exchanges in each of these treatments. The resulting off-white tin (IV) oxide product (54.0 grams) has an average particle diameter size of about 90 Angstroms as measured by transmission electron microscopy, and a specific resistivity determined by known methods, and more specifically as indicated herein, see Example IV, of 18 ohm-cm was obtained on a pressed pellet sample.

EXAMPLE II

The following procedure illustrates the preparation of a conductive doped tin oxide powder:

Nitrogen gas (2.0 liters per minute) was bubbled through tin tetrachloride at room temperature, and was then passed over a bed of bismuth trichloride crystals maintained at a temperature of about 160° C. by electric heaters. The resulting vapor was mixed with oxygen and hydrogen both flowing at about 0.7 liter per minute. The resulting gas mixture was maintained at 160° C. and burned in a flame. The molar ratios of the gas mixture were about the same as in Example I except for added traces of bismuth trichloride at about 0.3 percent molar versus tin tetrachloride. The combustion products were allowed to agglomerate in flight for about 10 seconds in a glass tube heated to about 200° C., and then collected in a Teflon TM fabric filter by suction. The collected doped tin oxide product (60.0 grams) was subsequently heated in a 500 milliter rotating flask at 400° C. A stream of air and water vapor was passed into the flask for 30 minutes, followed by a stream of hydrogen gas, argon gas and water vapor for another 30 minutes. The gas flow rate was adjusted to give more than 10 flask volume exchanges in each of these treatments. The resulting off-white doped tin (IV) oxide powder (59.0 grams) has an average primary particle size of about 100 Angstroms as measured by transmission electron microscopy, and a specific resistivity of 11 ohm-cm was obtained on a pressed pellet sample as indicated herein.

EXAMPLE III

The following procedure illustrates the preparation of a conductive silane-treated tin oxide powder:

Tin (IV) oxide powder (50.0 grams) as prepared in Example I was placed into a rotating 500 milliliter flask heated at 300° C. Hexamethyl disilazene vapor generated by passing a stream of argon into liquid hexamethyl disilazene (16.0 grams) in another flask was passed into the flask containing tin oxide powder. The resulting off-white silane-treated tin (IV) oxide powder had an average primary particle size of about 10 Angstroms as measured by transmission electron microscopy, and a specific resistivity of 210 ohm-cm was obtained as indicated in Example I on a pressed pellet sample.

EXAMPLE IV

The following example illustrates the preparation of a 17.2 micron red magnetic encapsulated toner comprised of a polyether-urea shell, a core of poly(lauryl methacrylate), Lithol Scarlet pigment, iron powder, and titanium dioxide, and the conductive tin oxide powder of Example I as a shell surface additive.

A mixture of lauryl methacrylate (113.0 grams, available as Rocryl 320 from Rohm and Haas), Isonate 143L (42.0 grams), Desmodue E-21 (5.7 grams), free radical initiators Vazo 52 (1.6 grams), and Vazo 64 (1.6 grams), was thoroughly mixed at 4,000 rpm using an IKA T-50 polytron with a G45/M probe for 30 seconds. To this mixture were added titanium dioxide powder (rutile form, 90.0 grams), Sicopur 4068 TM iron powder (245.0 grams) and Lithol Scarlet pigment (29.0 grams), followed by blending at 8,000 rpm for 3 to 5 minutes. To the resulting slurry was then added one liter of a 0.10 percent aqueous poly(vinyl alcohol) solution, and the mixture resulting was then homogenized at 9,000 rpm for 2 minutes. The resulting dispersion was transferred to a two liter kettle equipped with a mechanical stirrer. Bis(3-aminopropyl)piperazine (33.0 grams) was then added to the flask, and the resulting mixture was stirred for one hour at room temperature. Subsequently, the reaction mixture was heated in an oil bath, with the temperature of the bath being raised from ambient temperature to 90° C. over a period of 45 minutes, and then held at this temperature for another 6 hours. After cooling to room temperature, the mixture was permitted to remain at room temperature to allow the encapsulated particle product to settle to the bottom of the reaction kettle. The particles were washed repeatedly with water until the aqueous phase was clear. The wet encapsulated particles were sieved through a 180 micron screen, and freeze dried to provide 350.0 grams of red encapsulated particles.

A mixture of 120.0 grams of the red encapsulated particles as obtained above and 9.0 grams of the conductive tin oxide powder of Example I was dry blended in a Lightnin CBM dry blender at 3,000 rpm for 20 minutes, followed by sieving through a 63 micron screen. The resulting red encapsulated toner had a volume average particle diameter of 17.2 microns and a particle size distribution of 1.33 as determined by the Coulter Counter measurement using Coulter Counter Model ZM, available from Coulter Electronics, Inc.

The volume resistivity of the toner was measured by gently filling a 1 $cm^3$ cell sitting on a horseshoe magnet with the above powdered toner sample. Two opposite walls of the cell are comprised of 1 centimeter × 1 centimeter conductive metal plates. The other two walls and the bottom of the cell are also 1 centimeter × 1 centimeter in dimension, but are comprised of insulating material. A voltage of 10 volts is applied across the plates, and the current flowing through the plates is measured using an electrometer. The device is standardized using a nickel standard whose saturation magnetic moment is known (55 emu/gram). The nickel sample is magnetized between two magnetic pole faces with a saturating magnetic field of 2,000 Gauss such that the induced magnetic field is perpendicular to one of the faces of the cell. The integrated current that is induced when the nickel sample is removed from the saturating magnetic field is measured. Next, the integrated current induced by a toner sample under identical conditions is also measured. The encapsulated toner saturation magnetic moment is then obtained by referencing its induced current per gram of sample to that of the nickel sample. For the toner of this example, the saturation magnetic moment was measured to be 49 emu per gram, and its volume resistivity was measured to be $8.5 \times 10^6$ ohm-cm. The specific resistivity of the metal oxide powders can be determined in a similar manner, or by other known methods.

The above prepared toner was evaluated in a Xerox 4060 TM printer. The toned images were transfixed onto paper with a transfix pressure of 2,000 psi. Print quality was evaluated from a checkerboard print pattern. The image optical density was measured with a standard integrating densitometer. Image fix was measured by the standardized scotch tape pull method, and is expressed as a percentage of the retained image optical density after the tape test relative to the original image optical density. Image smearing was evaluated qualitatively by hand rubbing the fused checkerboard print using a blank paper under an applied force for a specific cycle time, and viewing the surface cleanliness of nonprinted and printed areas of the page. Image ghosting on paper was evaluated visually. For the above prepared toner, the image fix level was 84 percent, and no image smear and no image ghosting were observed in this machine testing for at least 2,000 prints. The toner displayed a resistance to agglomeration even when heated at 55° C. for 48 hours.

EXAMPLE V

The following example describes the preparation of an 18.8 micron blue magnetic encapsulated toner comprised of a polyether-urea shell and a core of poly(lauryl methacrylate), Hostaperm Blue pigment, iron powder, and titanium dioxide together with the conductive tin oxide powder of Example I as a surface additive.

The blue toner was prepared in accordance with the procedure of Example IV except that Hostaperm Blue pigment (Hoechst) was employed in place of Lithol Scarlet pigment. Three hundred and twenty (320.0) grams of blue encapsulated particles were obtained after freeze drying, and these particles were then dry blended in accordance with the procedure of Example IV yielding a blue encapsulated toner with a volume average particle diameter of 18.8 microns and a particle size distribution of 1.35. The toner's saturation magnetic moment was measured to be 50 emu per gram, and the toner volume resistivity was found to be $9.5\times10^6$ ohm-cm.

The above prepared toner was evaluated according to the procedure of Example IV. For this toner, the image fix level was 82 percent, and no image ghosting and no image smear were observed. This toner displayed a resistance to agglomeration even when heated at 55° C. for 48 hours.

EXAMPLE VI

A 13.2 micron blue encapsulated toner comprised of a polyether-urea shell and a core of polysiloxane-containing poly(lauryl methacrylate), iron powder, Heliogen Blue pigment, and titanium dioxide together with the conductive doped tin oxide powder of Example II as a surface additive was prepared as follows:

The toner was prepared in accordance with the procedure of Example IV with the exception that a mixture of 103.0 grams of lauryl methacrylate and 10.0 grams of methacryloxypropyl terminated polydimethylsiloxane (viscosity of 1,500 to 2,500 centistokes) was employed in place of 113.0 grams of lauryl methacrylate. In addition, 25.0 grams of Heliogen blue pigment (BASF) was utilized instead of 29.0 grams of Lithol Scarlet pigment. The encapsulated particles obtained after freeze drying were dry blended with 4.2 percent by weight of the conductive doped tin oxide powder of Example II affording a blue encapsulated toner with a volume average particle diameter of 13.2 microns and a particle size distribution of 1.37. The toner's saturation magnetic moment was measured to be about 42 emu per gram, and the toner volume resistivity was found to be $8.6\times10^5$ ohm-cm. For this toner, the image fix level was 81 percent, and no image smear and no image ghosting were observed after 2,000 prints. This toner did not show any signs of agglomeration with storage for seven months.

EXAMPLE VII

A 14.0 micron green encapsulated toner with a polyether-urea shell, a poly(lauryl methacrylate) core binder and Sicopur 4068 TM iron powder material was prepared in accordance with the procedure of Example IV except that Hostaperm Green pigment (Hoechst) was utilized in place of Lithol Scarlet pigment. The encapsulated particles obtained after freeze drying were dry blended with 4.5 percent by weight of conductive doped tin oxide powder of Example II. The green encapsulated toner as obtained in this manner has a volume average diameter of 14.0 microns and a particle size distribution of 1.36. The toner's volume resistivity was $1.3\times10^6$ ohm-cm, and its saturation magnetic moment was measured to be 48 emu per gram. The toner was evaluated in accordance with the procedure of Example IV, and substantially similar results were obtained.

EXAMPLE VIII

A 15.3 micron brown encapsulated toner with a polyether-urea shell and a core of poly(lauryl methacrylate), Magnox iron oxide TMB-50 TM, Microlith brown pigment, and titanium dioxide was prepared in accordance with the procedure of Example IV except that 300 grams of Magnox iron oxide TMB-50 TM and 5.0 grams of Microlith Brown pigment was used instead of Sicopur 4068 TM iron powder and Lithol Scarlet pigment (BASF), respectively. The encapsulated particles obtained after freeze drying were dry blended with 5.5 percent by weight of the conductive silane-treated doped tin oxide powder of Example III. The toner had a volume average particle diameter of 15.3 microns and a particle size distribution of 1.34. The toner displayed a volume resistivity of $6\times10^7$ ohm-cm and a saturation magnetic moment of 45 emu per gram. For this toner, image fix was 79 percent with no signs of image smear, image ghosting, or toner agglomeration.

EXAMPLE IX

A 13.8 micron blue encapsulated toner with a polyurea shell and a (lauryl methacrylate-stearyl methacrylate) copolymeric core resin was prepared as follows:

A mixture of lauryl methacrylate (93.0 grams), stearyl methacrylate (20.0 grams) Isonate 143L (42.0 grams), Desmodue E-21 (5.7 grams), Vazo 52 (1.6 grams), and Vazo 64 (1.6 grams) was thoroughly mixed at 4,000 rpm using an IKA T-50 polytron with a G45/M probe for 30 seconds. To this mixture were added titanium dioxide powder (rutile form, 90 grams), Sicopur 4068 TM iron powder (245.0 grams) and Heliogen Blue pigment (25.0 grams, BASF), followed by blending at 8,000 rpm for 3 to 5 minutes. To the resulting slurry was then added one liter of a 0.10 percent aqueous poly(vinyl alcohol) solution, and the mixture was then homogenized at 9,000 rpm for 2 minutes. The dispersion was transferred to a two liter reaction kettle, and into this mixture was added bis(3-aminopropyl)piperazine (33.0 grams). The resulting mixture was stirred at room temperature for 1 hour. Subsequently, the reaction mixture was heated in an oil bath with the temperature of the bath being raised from ambient temperature to 90° C. over a period of 45 minutes, and then held at this temperature for another 6 hours. After cooling to room temperature, the mixture was permitted to remain at room temperature to allow the encapsulated particle product to settle to the bottom of the reaction kettle. The particles were washed repeatedly with water until the aqueous phase was clear. The wet encapsulated particles were sieved through a 180 micron screen, and freeze dried to provide 365.0 grams of blue encapsulated toner particles. The aforementioned blue encapsulated particles were dry blended with 5.5 percent by weight of the conductive silane-treated doped tin oxide powder of Example III. The resulting toner displayed a volume average particle diameter of 13.8 microns and a particle size distribution of 1.33. This toner exhibited a saturated magnetic moment of 43 emu per gram, and a volume resistivity of $2.0\times10^7$ ohm-cm. The toner was machine tested in a Delphax S6000 TM printer, and substantially similar results were obtained as reported in Example IV.

EXAMPLE X

A 14.6 micron red encapsulated toner comprised of a polyether-urea shell, a core of poly(lauryl methacrylate), Lithol Scarlet pigment, iron powder, and titanium dioxide was prepared in accordance with the procedure of Example IV. The encapsulated particles obtained after freeze drying were dry blended with 5.5 percent by weight of the conductive silane-treated doped tin oxide of Example III. The red encapsulated toner product has a volume average particle diameter of 14.6 microns and a particle size distribution of 1.34. Its volume resistivity was found to be $8.8\times10^6$ ohm-cm and its saturated magnetic moment was 44 emu per gram. The toner was evaluated in a Delphax S6000 TM printer, and substantially similar results were obtained as reported in Example IV.

Other modifications of the presrnt invention may occur to those skilled in the art subsequent to a review of the present application, and these modifications are intended to be included within the scope of the present invention.

What is claimed is:

1. A colored magnetic encapsulated toner composition consisting essentially of a core comprised of a polymer binder, a colorless or lightly colored magnetic material, a color pigment, dye or mixture thereof excluding black, and a whitening agent; and which core is encapsulated in a polymeric shell containing a metal oxide or a mixture of metal oxides, which metal oxide or metal oxides has been surface treated with a silane component and wherein the said encapsulated toner composition has a volume resistivity of from about $10^3$ ohm-cm to about $10^8$ ohm-cm.

2. A colored conductive magnetic encapsulated toner composition consisting essentially of a core consisting essentially of a polymer binder, a substantially colorless magnetic material, a color pigment excluding black, and a whitening agent present in an amount of from about 1 to about 20 weight percent; and which core is encapsulated in a polymeric shell containing thereon a conductive metal oxide powder; and wherein the toner has a volume resistivity of from about $10^3$ ohm-cm to about $10^8$ ohm-cm.

3. A colored magnetic encapsulated toner composition consisting essentially of a core comprised of a polymer binder, a grayish color magnetic material, a pigment, and a whitening agent presnt in an amount of from about 1 to about 20 weight percent and selected from the group consisting of aluminum oxide, barium oxide, calcium carbonate, calcium oxide, magnesium oxide, magnesium stearate, titanium oxide, tin oxide, zinc oxide, and zinc stearate; and wherein the core is encapsulated in a polymeric shell containing a metal oxide and wherein said encapsulated toner composition has a volume resistivity of from about $10^3$ ohm-cm to about $10^8$ ohm-cm.

4. An encapsulated toner composition in accordance with claim 3 wherein the metal oxide is aluminum oxide, antimony oxide, barium oxide, bismuth oxide, cadmium oxide, chromium oxide, germanium oxide, indium oxide, lithium oxide, magnesium oxide, molybdenum oxide, nickel oxide, niobium oxide, ruthenium oxide, silicon oxide, tantalum oxide, titanium oxide, tin oxide, vanadium oxide, zinc oxide, or zirconium oxide.

5. A toner composition in accordance with claim 1 wherein the metal oxide is a conductive powder of aluminum oxide, antimony oxide, barium oxide, bismuth oxide, cadmium oxide, chromium oxide, germanium oxide, indium oxide, lithium oxide, magnesium oxide, molybdenum oxide, nickrl oxide, niobium oxide, ruthenium oxide, silicon oxide, tantalum oxide, titanium oxide, tin oxide, vanadium oxide, zinc oxide, or zirconium oxide, and mixtures thereof.

6. A toner composition in accordance with claim 1 wherein said mixture of metal oxides is selected from the group consisting of aluminum oxide, antimony oxide, barium oxide, bismuth oxide, cadmium oxide, chromium oxide, germanium oxide, indium oxide, lithium oxide, magnesium oxide, molybdenum oxide, nickel oxide, niobium oxide, ruthenium oxide, silicon oxide, tantalum oxide, titanium oxide, tin oxide, vanadium oxide, zinc oxide, or zirconium oxide.

7. An encapsulated toner composition in accordance with claim 2 wherein said oxide is selected from the group consisting of aluminum oxide, antimony oxide, barium oxide, bismuth oxide, cadmium oxide, chromium oxide, germanium oxide, indium oxide, lithium oxide, magnesium oxide, molybdenum oxide, nickel oxide, niobium oxide, ruthenium oxide, silicon oxide, tantalum oxide, titanium oxide, tin oxide, vanadium oxide, zinc oxide, zirconium oxide and mixtures thereof; and which mixtures contain from about 0.01 to about 50 mole percent of one oxide and from 50 mole percent to 99.99 mole percent of a second oxide.

8. A toner composition in accordance with claim 1 wherein the metal oxide is presemnt in an amount of from about 0.1 weight percent to about 20 weight percent.

9. An encapsulated toner composition in accordance with claim 2 wherein the metal oxide is present in an amount of from about 0.1 weight percent to about 20 weight percent.

10. A toner composition in accordance with claim 1 wherein the volume resistivity of the toner is from about $10^4$ ohm-cm to about $10^6$ ohm-cm.

11. An encapsulated toner composition in accordance with claim 2 where the toner's volume resistivity is from about $10^4$ ohm-cm to about $10^6$ ohm-cm.

12. A toner composition in accordance with claim 1 containing surface release additives.

13. A toner composition in accordance with claim 2 with flow air additives, surface release additives, or mixtures thereof.

14. A toner composition in accordance with claim 13 wherein the additive is present in an amount of from about 0.05 to about 5 weight percent.

15. A toner composition in accordance with claim 13 wherein the additive is comprised of metal salts, metal salts of fatty acids, or colloidal silicas.

16. A toner composition in accordance with claim 15 wherein zinc stearate is selected.

17. A toner composition in accordance with claim 2 wherein the toner is comprised of from about 3 to about 30 weight percent of shell polymer, from about 20 to about 75 weight percent of core binder, from about 1 to 20 weight percent of pigment, from about 20 to about 60 weight percent of a substantially colorless or light colored magnetic material, from about 1 to about 20 weight percent of a whitening agent, and from about 0.1 to about 20 weight percent of conductive metal oxide powder.

18. A toner composition in accordance with claim 2 wherein the shell polymer is a polyurea, polyurethane, polyamide, polyester, polycarbonate, or mixtures thereof, or derivatives thereof containing flexible polymethylene or polyether segments.

19. A toner composition in accordance with claim 2 wherein the core is derived from polymerization of one or more addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

20. A toner composition in accordance with claim 2 wherein the pigment is selected from the group consisting of Heliogen Blue L6900, D6840, D7080, D7020, Pylam Oil Blue and Pylam Oil Yellow, Pigment Blue 1, Pigment Violet 1, Pigment Rd 48, Lemon Chrome Yellow DCC 1026, E.D. Toluidine Red and Bon Red C, NOVAperm Yellow FGL, Hostaperm Pink E, Cinquasia Magenta, Lithol Scarlet, Hostaperm Blue, Hostaperm Red, Hostaperm Green, PV Fast Green, Cinquasia Yellow, PV Fast Blue, 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra-(octadecyl sulfonamido) phthalocyanine, x-copper phthalocyanine pigment listed in the Color Index as CI 74160, CI Pigment Blue, and Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL.

21. A toner composition in accordance with claim 2 wherein the magnetic material is selected from the group consisting of Sicopur 4068 FF TM, cobalt powder, Metglas TM and Metglas TM ultrafine, treated iron oxides; carbonyl iron Sf TM, Mapico Tan TM; nickel powder; chromium powder; and manganese ferrites.

22. A toner composition in accordance with claim 1 wherein the whitening agent is an inorganic white powder selected from the group consisting of powdered aluminum oxide, barium oxide, calcium carbonate, calcium oxide, magnesium oxide, magnesium stearate, titanium oxide, tin oxide, zinc oxide, and zinc stearate.

23. A toner composition in accordance with claim 3 wherein the metal oxide is tin oxide, tin oxide doped with bismuth, tin oxide doped with antimony, titanium oxide, titanium oxide doped with tantalum, titanium oxide doped with antimony, or titanium oxide doped with indium.

24. A toner composition in accordance with claim 23 wherein the dopant in the metal oxide is present in an amount of from about 0.1 to about 20 mole percent.

25. An encapsulated toner consisting essentially of a core comprised of a polymer binder, colored pigment particles, a substantially colorless, or lightly colored magnetic material, and a whitening agent present in an amount of from about 1 to about 20 weight percent and selected from the group consisting of aluminium oxide, barium oxide, calcium carbonate, calcium oxide, magnesium oxide, magnesium stearate, titanium oxide, tin oxide, zinc oxide, and zinc stearate, which core is encapsulated in a polymeric shell containing colorless conductive components comprised of mixed oxides of tin and bismuth; mixed oxides of tin and antimony; mixed oxides of tin and tantalum; mixed oxides of tin and niobium; mixed oxides of titanium and bismuth; mixed oxides of titanium and antimony; mixed oxides of titanium an tantalum; mixed oxides of titanium and niobium.

26. A toner in accordance with claim 1 wherein the metal oxide is conductive and is a powder with an average diameter primary particle size of less than about 1,000 Angstroms.

27. A toner in accordance with claim 2 wherein the metal oxide is a powder with an average particle diameter of from about 10 to about 1,000 Angstroms.

28. A toner composition in accordance with claim 2 wherein the metal oxide powder particles have been surface treated with a silane component.

29. A toner composition in accordance with claim 28 wherein the silane component is hexamethyl disilazane, bis(trimethylsilyl)acetamide, alkyltrialkoxysilane, dialkyldialkoxysilane, alkoxytrialkylsilane, or siloxysilanes.

30. A toner composition in accordance with claim 1 wherein the polymer binder is present in an amount of from about 20 to about 78 weight percent of the toner, the magnetic material is present in an amount of from about 20 to about 60 weight percent, the color pigment, dye or mixtures thereof are present in an amount of from about 1 to about 20 weight percent, the whitening agent is present in an amount of from about 1 to about 20 weight percent, and the metal oxide is present in an amount of from about 0.1 to about 20 weight percent of toner.

31. A toner composition in accordance with claim 2 wherein the shell is present in an amount of from about 3 to about 30 weight percent of the toner, the core binder is present in an amount of from about 20 to about 75 weight percent of the toner, the magnetic material is present in an amount of from about 1 to about 20 weight percent, the pigment is present in an amount of from about 1 to about 20 weight percent, the whitening agent is present in an amoujnt of from about 1 to about 20 weight percent, and the metal oxide powder is present in an amount of from about 0.1 to about 20 weight percent of toner.

32. A toner composition in accordance with claim 2 wherein the shell polymer is a polyurea, a polyurethane, a polyamide, a polyester, or mixtures thereof.

33. A toner composition in accordance with claim 32 wherein the shell polymer contains flexible structural moieties.

34. An encapsulated toner composition in accordance with claim 33 wherein the flexible structural moieties are polyether or polymethylene segments.

35. An encapsulated toner composition in accordance with claim 32 wherein the polyurea is derived from the polycondensation of a mixture of polyisocyanate and polyether polyisocyanate with a diamine.

36. An encapsulated toner composition in accordance with claim 35 wherein the polyisocyanate and polyether polyisocyanate are selected from the group consisting of benzene diisocyanate, toluene diisocyanate, diphenylmethane diisocyanate, cyclohexane diisocyanate, hexane diisocyanate, and polyether polyisocyanates.

37. An encapsulated toner composition in accordance with claim 36 wherein liquid polyether polyisocyanates are selected.

38. An encapsulated toner composition in accordance with claim 2 wherein the shell is formed by interfacial polycondensation.

39. An encapsulated toner composition in accordance with claim 2 wherein the core binder is an acrylate, a methacrylate, a styrene polymer, or the copolymers thereof.

40. An encapsulated toner composition in accordance with claim 3 wherein the core polymer binder is derived from polymerization of addition monomer or monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

41. An encapsulated toner composition in accordance with claim 28 wherein the core polymer binder is derived from polymerization of addition monomer or monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

42. An encapsulated toner composition in accordance with claim 3 wherein the pigment is selected from the group consisting of Heliogen Blue, Pylam Oil Blue, Pylam Oil Yellow, Pigment Blue, Pigment Violet, Pigment Red, Lemon Chrome Yellow, Bon Red, NOVAperm Yellow FGL, Hostaperm Pink, 2,9-dimethyl-substituted quinacridone, Dispersed Red, Solvent Red, copper tetra(octyldecyl sulfonamido) phthalocyanine, copper phthalocyanine, diarylide yellow 3,3-dichlorobenzidene acetoacetanilides, a nitrophenyl amine sulfonamide, Dispersed Yellow 2,5-dimethoxy-4-sulfonanilide phenylazo-4'-chloro-2,5-dimethoxy acetoacetanilide, and Permanent Yellow FGL.

43. An encapsulated toner composition in accordance with claim 2 wherein the metal oxide is comprised of from about 80 to about 95 weight percent of tin oxide and from about 5 to about 20 weight percent of bismuth.

44. An encapsulate colored toner composition in accordance with claim 2 wherein the metal oxide is comprised of from about 80 to about 95 weight percent of titanium oxide and from about 5 to about 20 weight percent of bismuth.

45. An encapsulated toner composition in accordance with claim 2 wherein the metal oxide is comprised of from about 80 to about 95 weight percent of tin oxide and from about 5 to about 20 weight percent of antimony.

46. An encapsulated toner composition in accordance with claim 2 wherein the metal oxide is comprised of from about 80 to about 95 weight percent of titanium oxide and from about 5 to about 20 weight percent of antimony.

47. An encapsulated toner composition in accordance with claim 3 wherein the magnetic material is selected from the group consisting of iron powder, cobalt powder, nickel powder, treated iron oxide powder, and a combination of two or more of these metal powders.

48. An encapsulated toner composition in accordance with claim 47 wherein iron powder or cobalt powder is selected.

49. An encapsulated toner composition in accordance with claim 2 wherein the pigment is a cyan pigment or dye, magenta pigment or dye, yellow pigment or dye, or mixtures thereof; blue, green, red, brown pigment or dye, or mixtures thereof.

50. An electrostatic imaging method which comprises the formation of a latent electrostatic image on an imaging member; subsequently developing the image with the toner composition of claim 1; transferring the image to a suitable substrate and affixing the image thereto.

51. An electrostatic imaging method which comprises the formation of a latent electrostatic image on an imaging member; subsequently developing the image with the encapsulated toner of claim 2; transferring the image to a suitable substrate and affixing the image thereto.

52. An electrostatic imaging method which comprises the formation of a latent electrostatic image on an imaging member; subsequently developing the image with the encapsulated toner of claim 3; transferring the image to a suitable substrate and affixing the image thereto.

53. A toner composition in accordance with claim 2 with a volume resistivity of from about $10^4$ ohm-cm to about $10^6$ ohm-cm.

54. A toner composition in accordance with claim 3 with a volume resistivity of from about $10^3$ ohm-cm to about $10^8$ ohm-cm.

55. A toner composition in accordance with claim 3 with a volume resistivity of from about $10^4$ ohm-cm to about $10^6$ ohm-cm.

* * * * *